US009620149B2

(12) United States Patent
Sasaki et al.

(10) Patent No.: US 9,620,149 B2
(45) Date of Patent: Apr. 11, 2017

(54) COMMUNICATION DEVICE

(71) Applicant: FUJITSU LIMITED, Kawasaki-shi, Kanagawa (JP)

(72) Inventors: Hitoshi Sasaki, Yokohama (JP); Kaori Endo, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 119 days.

(21) Appl. No.: 14/592,802

(22) Filed: Jan. 8, 2015

(65) Prior Publication Data

US 2015/0213812 A1 Jul. 30, 2015

(30) Foreign Application Priority Data

Jan. 28, 2014 (JP) ..... 2014-013633

(51) Int. Cl.

| | |
|---|---|
| ***G10L 19/008*** | (2013.01) |
| ***H04R 3/04*** | (2006.01) |
| ***G10L 25/90*** | (2013.01) |
| ***G10L 21/038*** | (2013.01) |
| ***G10L 21/034*** | (2013.01) |

(52) U.S. Cl.

CPC ..... *G10L 25/90* (2013.01); *G10L 21/034* (2013.01); *G10L 21/038* (2013.01)

(58) Field of Classification Search

CPC combination set(s) only.

See application file for complete search history.

(56) References Cited

U.S. PATENT DOCUMENTS

| | | | | |
|---|---|---|---|---|
| 2003/0004723 | A1* | 1/2003 | Chihara | G10L 13/08 704/260 |
| 2011/0075832 | A1 | 3/2011 | Tashiro | |
| 2011/0184731 | A1* | 7/2011 | Kim | G10L 21/038 704/205 |
| 2012/0016669 | A1 | 1/2012 | Endo et al. | |
| 2013/0065542 | A1* | 3/2013 | Proudkii | H03H 11/1291 455/78 |

FOREIGN PATENT DOCUMENTS

| | | |
|---|---|---|
| EP | 2555188 | 2/2013 |
| JP | 2003-255973 A | 9/2003 |
| JP | 2010-026323 A | 2/2010 |
| JP | 2010-204564 | 9/2010 |
| JP | 2012-022166 A | 2/2012 |

OTHER PUBLICATIONS

Extended European Search Report of European Patent Application No. 15150456.0 dated Jun. 16, 2015.

* cited by examiner

*Primary Examiner* — David Hudspeth
*Assistant Examiner* — Shreyans Patel
(74) *Attorney, Agent, or Firm* — Maschoff Brennan

(57) ABSTRACT

A communication device includes a memory, and a processor coupled to the memory, configured to extract a component of a voice signal that is input, detect a speech rate of the voice signal, adjust the extracted component, based on the detected speech rate, and add the adjusted component to the voice signal to expand a band of the voice signal.

17 Claims, 12 Drawing Sheets

ORIGINAL SOUND

FORMANT
(F1 FREQUENCY)

PITCH STRENGTH
(MAXIMUM AUTOCORRELATION)

COMMUNICATION DEVICE

CROSS-REFERENCE TO RELATED APPLICATION

This application is based upon and claims the benefit of priority from the prior Japanese Patent Application No. 2014-013633 filed on Jan. 28, 2014, the entire contents of which are incorporated herein by reference.

FIELD

The embodiments discussed herein are related to a communication device.

BACKGROUND ART

The technologies for achieving pseudo-expansion of the frequency band of a voice signal that has been converted to a narrower band for communication on the side of a receiving device have been disclosed in the related art documents mentioned below. The technologies have been disclosed in Japanese Laid-open Patent Publication No. 2012-022166 and Japanese Laid-open Patent Publication No. 2003-255973.

SUMMARY

According to an aspect of the invention, a communication device includes a memory, and a processor coupled to the memory, configured to extract a component of a voice signal that is input, detect a speech rate of the voice signal, adjust the extracted component, based on the detected speech rate, and add the adjusted component to the voice signal to expand a band of the voice signal.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Hereinafter, embodiments of the present disclosure will be described with reference to the drawings.

Figure 1:
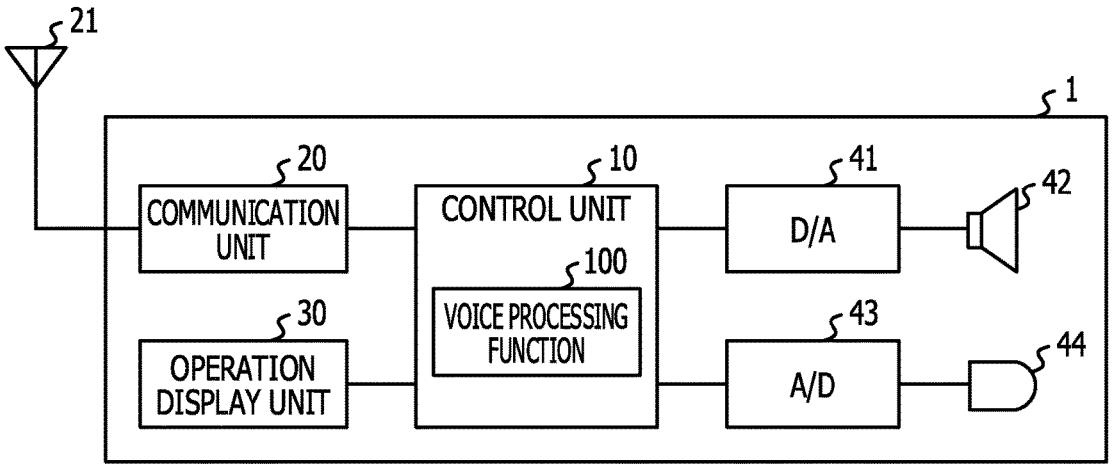
FIG. 1 is a diagram illustrating an example of a configuration of a communication device having a voice processing function.

First, with reference to FIG. 1, the configuration of a communication device having a voice processing function in this embodiment will be described. FIG. 1 is a diagram illustrating an example of the configuration of a communication device having a voice processing function.

In FIG. 1, a communication device 1 includes a control unit 10, a communication unit 20, an operation display unit 30, a digital-to-analog (D/A) conversion unit 41, a speaker 42, an A/D conversion unit 43, and a microphone 44.

The communication unit 20 is coupled to an antenna 21 and performs communication control of the wireless communication via the antenna 21. The communication unit 20 may be implemented, for example, by exclusive-use communication control hardware.

The operation display unit 30 provides various types of user interfaces to the user of the communication device 1 to allow operational input by the user. The operation display unit 30 may be implemented, for example, by a touch panel.

The D/A conversion unit 41 converts voice data input by a far-end terminal (a terminal serving as a communication partner), for example, via the communication unit 20 and processed by a voice processing function 100 of the control unit 10, to analog data and outputs a voice to the speaker 42.

The A/D conversion unit 43 converts a voice input from the microphone 44 to digital data and inputs the digital data to the control unit 10.

Figure 2:
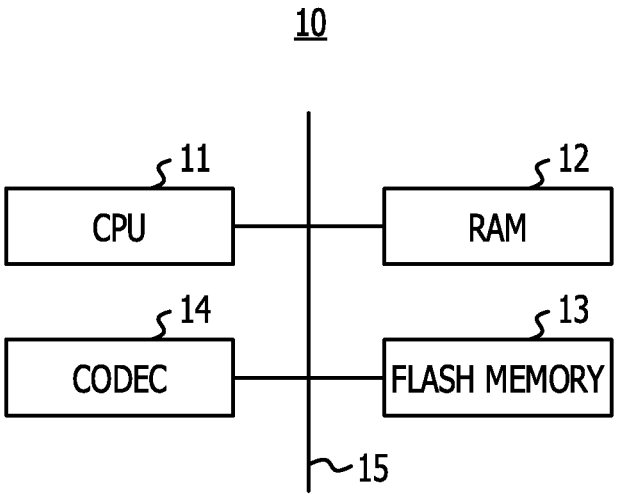
FIG. 2 is a diagram illustrating an example of a hardware configuration of a control unit.

The control unit 10 controls operations of the communication device 1. The control unit 10 includes the voice processing function 100. Details of the control unit are described with reference to FIG. 2. FIG. 2 is a diagram illustrating an example of a hardware configuration of the control unit.

In FIG. 2, the control unit 10 includes a central processing unit (CPU) 11, a random access memory (RAM) 12, a flash memory 13, and a codec 14. The CPU 11 executes programs stored in the RAM 12 or the flash memory 13. The flash memory 13 is a rewritable nonvolatile memory, in which programs and data may be stored. The codec 14 performs codec processing that encodes or decodes data transmitted and received by the communication device 1. In this embodiment, the codec 14, which uses hardware dedicated to the codec 14, may be implemented by storing codec programs in the flash memory 13, reading them into the RAM 12, and executing them with the CPU 11.

With reference to FIG. 1, the control unit 10 implements the voice processing function 100 by executing programs stored in the flash memory 13 and the like.

The voice processing function 100 performs pseudo band expansion processing on a voice signal (hereinafter abbreviated as "input voice") input from the far-end terminal. The pseudo band expansion processing is processing that achieves pseudo-expansion of the frequency band of a voice signal (hereinafter abbreviated as "output voice") output by adding a voice signal having a high frequency to an input voice from the far-end terminal using a frequency band that is restricted in accordance with the transmission speed of wireless communication performed via the communication unit 20.

Although, in this embodiment, the voice processing function 100 is described as what is implemented by programs stored in the flash memory 13 and the like, for example, the same function may be implemented by hardware or middleware.

Note that the control unit 10 described in conjunction with FIG. 2 may be, for example, an application specific integrated circuit (ASIC) created for communication control applications. The ASIC may include an analog circuit for communication in addition to a central processing unit (CPU) or a digital circuit consisting of memory and the like.

First Embodiment

Figure 3:
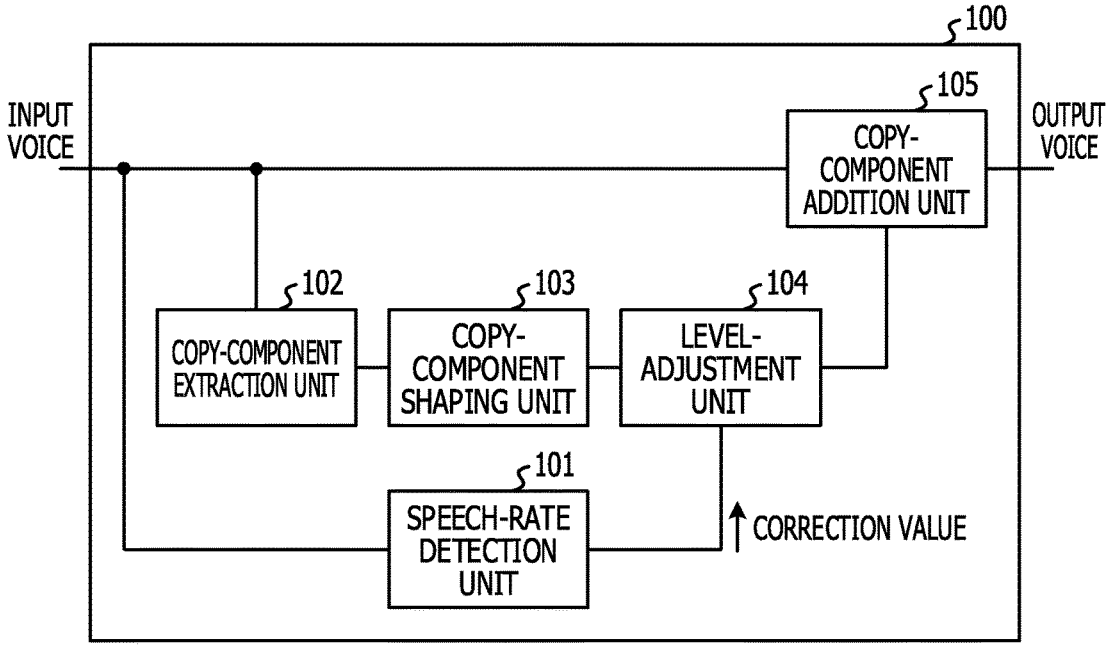
FIG. 3 is a diagram illustrating an example of a configuration of the voice processing function in a first embodiment.

Next, with reference to FIG. 3, details of the voice processing function 100 in the first embodiment will be described. FIG. 3 is a diagram illustrating an example of a configuration of the voice processing function in the first embodiment.

In FIG. 3, the voice processing function 100 includes a speech-rate detection unit 101, a copy-component extraction unit 102, a copy-component shaping unit 103, a level-adjustment unit 104, and a copy-component addition unit 105.

The speech-rate detection unit 101 detects and determines the speech rate of an input voice that is input from the far-end terminal via the communication unit 20 and is decoded by the codec 14. The speech rate is the utterance speed at which a speaker utters. Details of a method of detecting the speech rate will be described below.

The copy-component addition unit 102 extracts a component having a specific frequency band in an input voice as a copy component to be copied in a process of pseudo band expansion. During extraction of a copy component, fast Fourier transform (FFT) processing is performed on an input voice to extract a voice having a frequency band set in advance. The sampling frequencies of FFT processing are, for example, 8 kHz for an input voice and 16 kHz for an output voice.

The copy-component shaping unit 103 shapes the waveform of a copy component extracted in the copy-component extraction unit 102. The wavelength is shaped by cutting the frequency range set for an input voice.

Figure 7A:
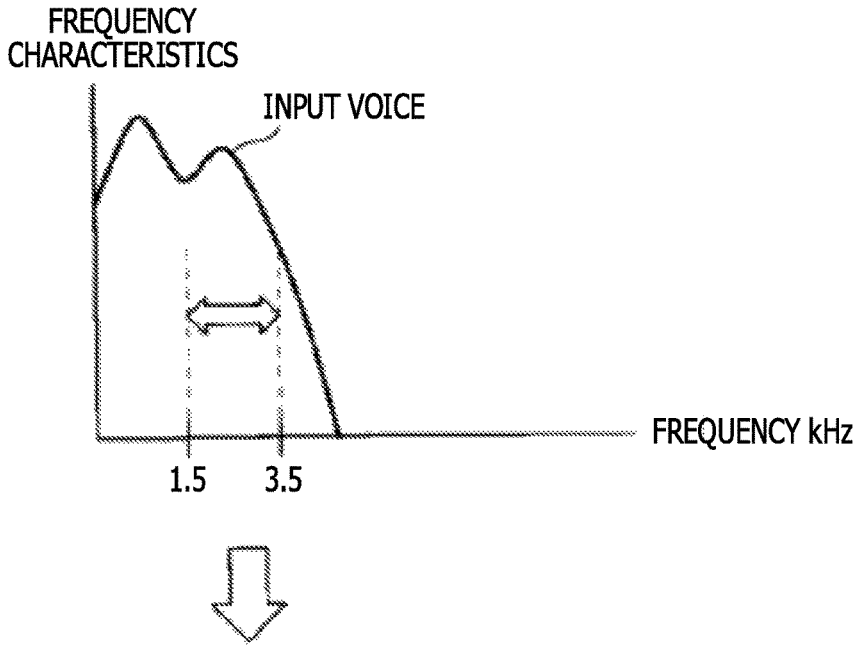
FIG. 7A is a graph illustrating data extraction from an input voice for explaining pseudo band expansion processing.
Figure 7B:
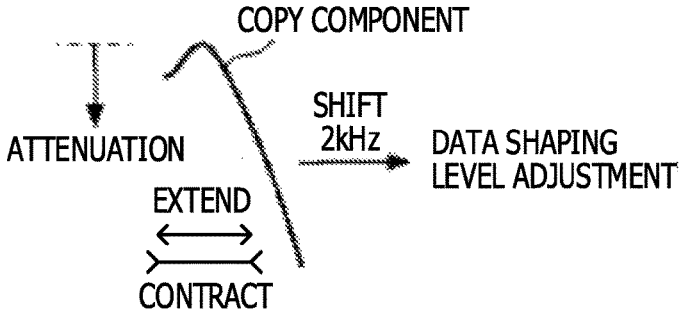
FIG. 7B is a representation illustrating shaping and level adjustment of extracted data.
Figure 7C:
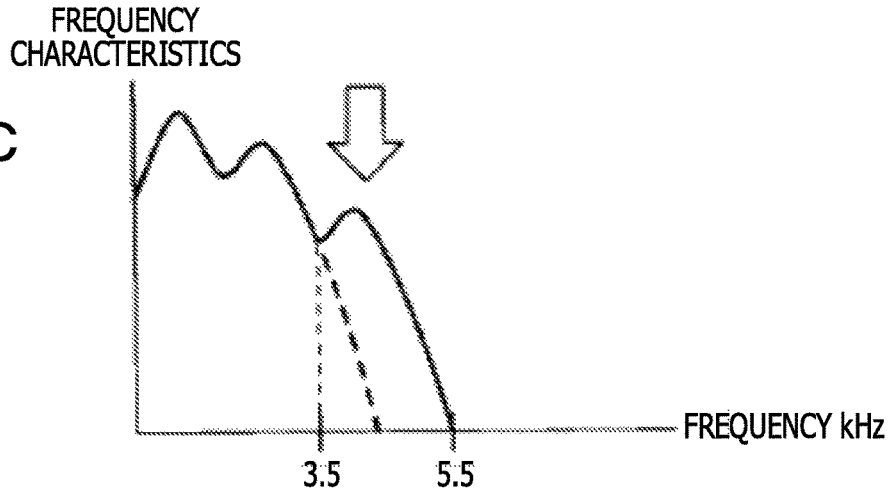
FIG. 7C is a graph illustrating data addition.

In accordance with a correction value input from the speech-rate detection unit 101, the level-adjustment unit 104 performs the copy-component level adjustment for a copy component input from the copy-component shaping unit 103. Details of level adjustment are described with reference to FIGS. 7A to 7C. FIGS. 7A to 7C are a graph illustrating data extraction from an input voice (7A), a representation illustrating shaping and level adjustment of extracted data (7B), and a graph illustrating data addition (7C) for explaining pseudo band expansion processing.

The level adjustment performed by the level-adjustment unit 104 is made, for example, by attenuating the volume (peak value) of a copy component by a predetermined attenuation factor. FIG. 7A is a graph illustrating the frequency characteristics of an input voice subjected to FFT processing.

FIG. 7B illustrates the case where, for the input voice illustrated in FIG. 7A, the copy-component extraction unit 102 extracts, as a copy component, the input voice in the range of 1.5 kHz to 3.5 kHz, and a predetermined attenuation factor is applied to the volume of the copy component output from the copy-component shaping unit 103. The level-adjustment unit 104 may change the attenuation factor in accordance with a correction value input from the speech-rate detection unit 101.

The level-adjustment unit 104 may adjust the amount of frequency shift relative to a copy component in accordance with a correction value input from the speech-rate detection unit 101. FIG. 7B illustrates the case where the volume of a copy component input from the copy-component shaping unit shifts by 2 kHz in a higher frequency direction. The copy component input from the copy-component shaping unit 103 is in the frequency range of 1.5 kHz to 3.5 kHz. When shifting to a higher frequency side by 2 kHz, the copy component falls in the range of 3.5 kHz to 5.5 kHz.

The level-adjustment unit 104 also may extend or contract the frequency band for a copy component in accordance with a correction value input by the speech-rate detection unit 101. The copy component illustrated in FIG. 7B is in the frequency range of 1.5 kHz to 3.5 kHz, and thus is in a frequency band of 2 kHz. For example, when the frequency band is extended to 3 kHz, the copy component has a waveform extending 1.5 times the length of the original waveform in the horizontal direction, as illustrated in FIG. 7B. Additionally, when the frequency band is contracted to 1 kHz, the copy component has a waveform contracted to one-half the length of the original waveform in the horizontal direction, as illustrated in the drawing.

The copy-component addition unit 105 adds the copy component adjusted by the level-adjustment unit 104 to the input voice. FIG. 7C is a graph in which the adjusted copy component has been added to the input voice by the copy-component addition unit 105. The copy component adjusted on the side with frequencies higher than 3.5 kHz is added such that the frequency band is expanded to 5.5 kHz in a pseudo manner.

Figure 4:
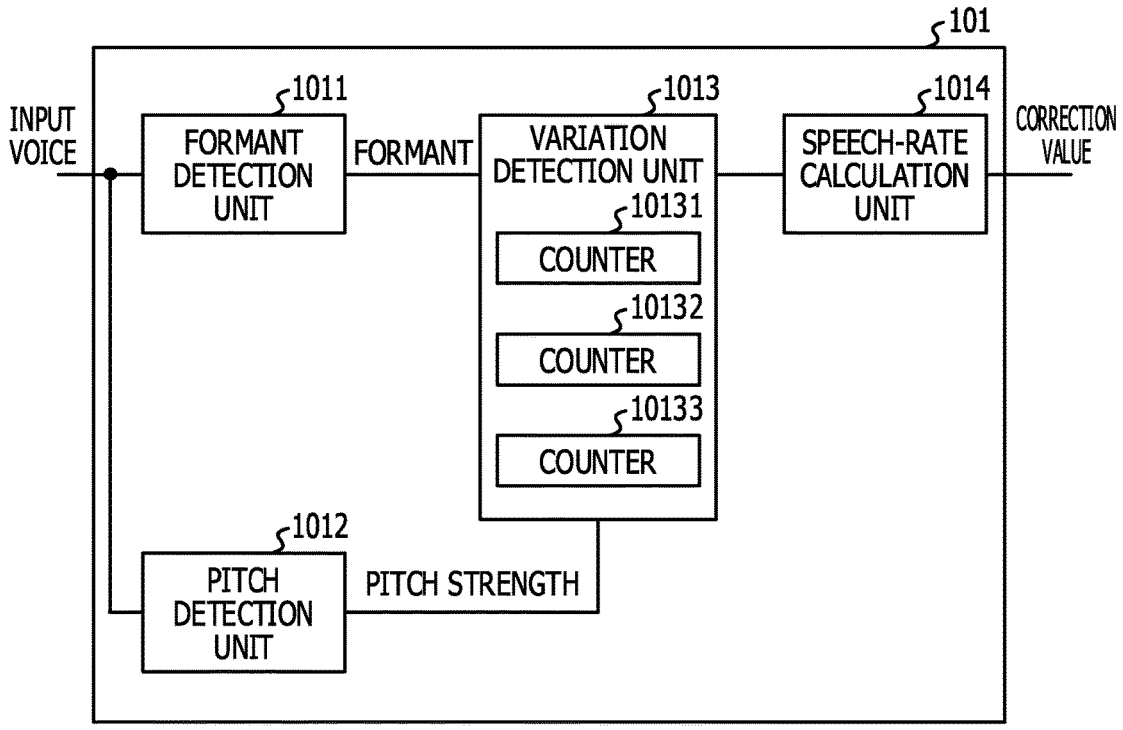
FIG. 4 is a diagram illustrating an example of a configuration of a speech-rate detection unit.

Next, with reference to FIG. 4, details of the speech-rate detection unit 101 described in conjunction with FIG. 3 will be described. FIG. 4 is a diagram illustrating an example of a configuration of a speech-rate detection unit.

In FIG. 4, the speech-rate detection unit 101 includes a formant detection unit 1011, a pitch detection unit 1012, a variation detection unit 1013, and a speech-rate calculation unit 1014.

The formant detection unit 1011 detects a formant (F1 frequency) in an input voice in every frame of the voice. The formant refers to a peak in the frequency spectrum of a voice uttered by a person. The F1 frequency is the lowest frequency among formants. Formants vary with time according to a person's pronunciation. When the formant frequency varies by greater than a certain value, it may be detected that the phoneme has changed. A change in formant may be detected by accumulating and averaging formants and using the degree of a change of a newly calculated formant relative to the obtained average. The formant detection unit temporally detects formants and outputs them to the variation detection unit 1013.

The pitch detection unit 1012 detects the pitch strength of an input voice. The pitch detection unit 1012 temporally detects the pitch strength and outputs it to the variation detection unit 1013.

A "voiced sound", as used herein, is a sound that involves vocal cord vibrations and exhibits periodic vibrations. In contrast, a "voiceless sound" is a sound that does not involve cord vibrations and exhibits non-periodic vibrations. The period of a voiced sound is determined by the period of vocal cord vibrations, and this is referred to as a "pitch frequency". The pitch frequency is a parameter of a sound that changes depending on the height and intonation of a voice.

In the first embodiment, the pitch detection unit 1012 measures an autocorrelation coefficient of pitch frequencies for a predetermined sampling time. The pitch detection unit 1012 may determine a pitch strength by further detecting a peak of the autocorrelation coefficient, and may determine a voiced sound portion or a voiceless sound portion in a voice depending on the magnitude of the pitch strength.

The variation detection unit 1013 detects the presence or absence of a change in the formant detected by the formant detection unit 1011 and a change in the pitch strength detected by the pitch detection unit 1012. The variation detection unit 1013 includes a counter 10131 that counts the F1 information of a formant, a counter 10132 that counts the number of continuous phonemes, that is, the length of continuous phonemes, and a counter 10133 that counts the number of phoneme transitions.

The speech-rate calculation unit 1014 calculates and determines a speech rate from the change in the formant and the change in the pitch strength detected by the variation detection unit 1013. Note that details of operations of the speech-rate detection unit 101 will be described below.

Figure 5:
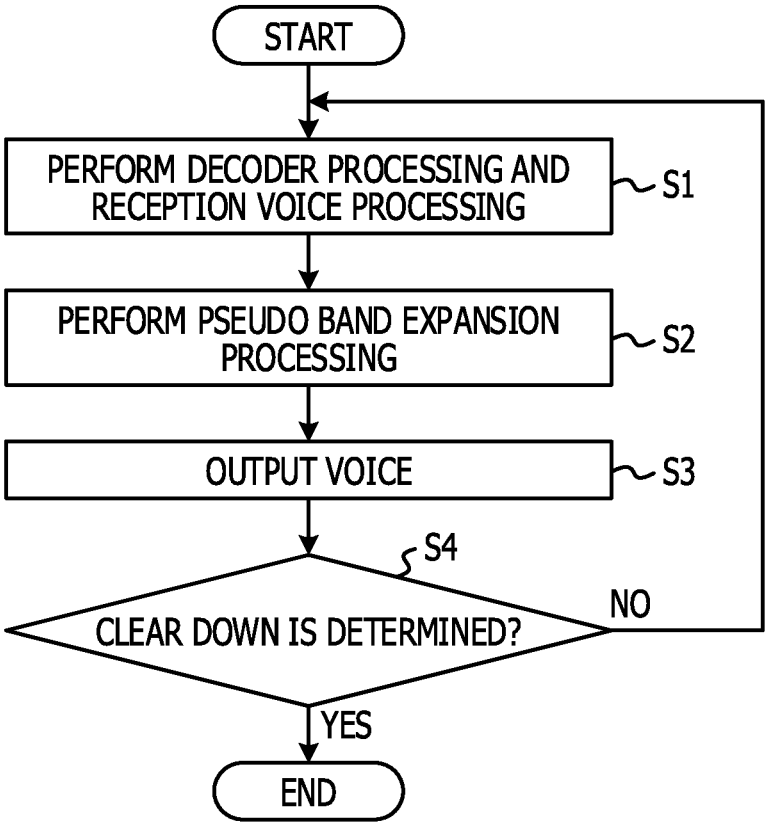
FIG. 5 is a flowchart illustrating an example of operations of the communication device.

Next, with reference to FIG. 5, operations of the communication device 1 performed by the control unit 10 will be described. FIG. 5 is a flowchart illustrating an example of operations of the communication device 1.

In FIG. 5, decoder processing and reception voice processing are performed (S1). Decoder processing and reception voice processing are performed by the codec 14 described in conjunction with FIG. 2. The reception voice processing performs pre-processing such as level adjustment and noise removal, for example, on a decoded voice.

Next, the control unit 10 performs pseudo band expansion processing on an input voice (S2). Details of pseudo band expansion processing will be described below.

Next, an output voice subjected to pseudo band expansion processing is output as a sound via the D/A conversion unit 41 and the speaker 42 (S3).

Next, the control unit 10 makes a clear-down determination (S4). A clear down is determined by whether, for example, an operation of the operation display unit 30 or an on-hook from the far-end terminal is performed. If a clear down is not determined (NO at S4), the process returns to step S1, where the process continues. If a clear down is determined (YES at S4), operations of the communication device 1 performed by the control unit 10 end.

Figure 6:
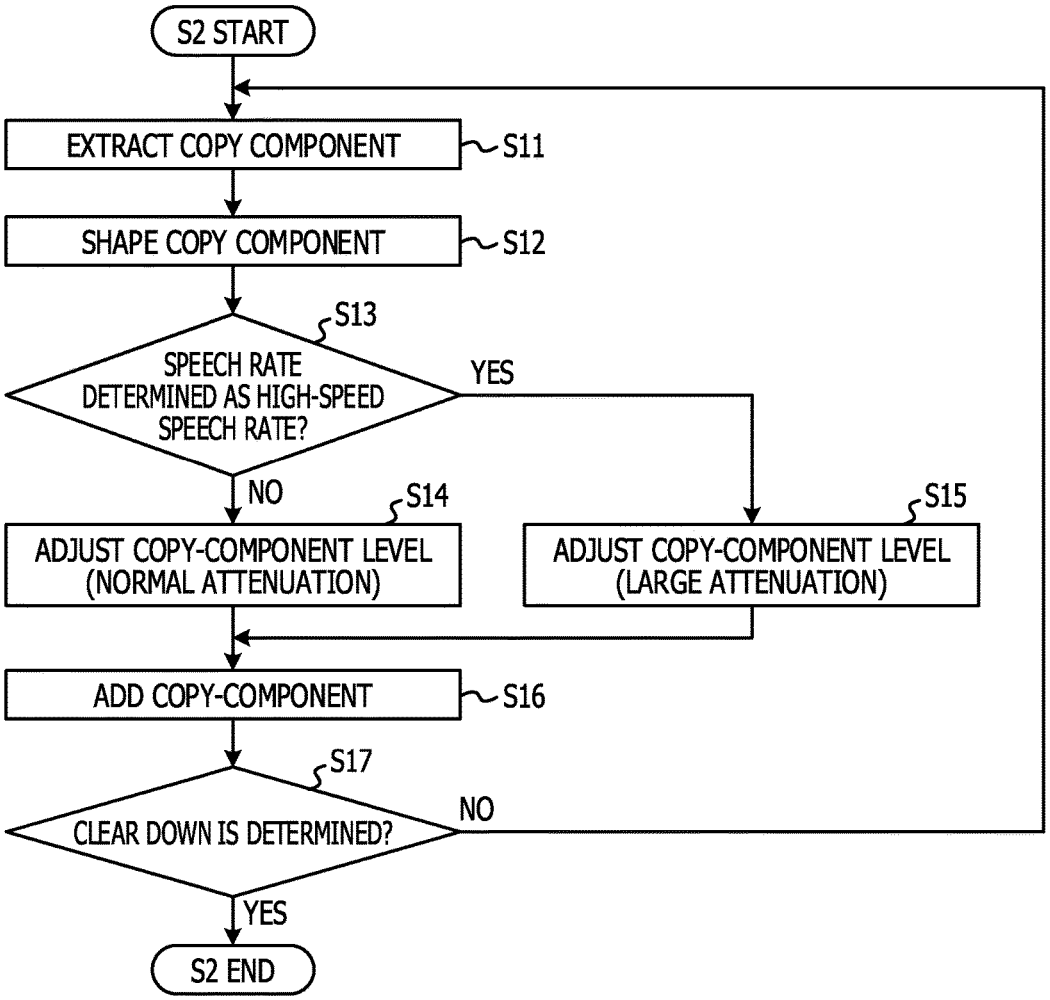
FIG. 6 is a flowchart illustrating an example of operations of a voice processing function.

Next, with reference to FIG. 6 and the aforementioned FIG. 3 and FIG. 7, details of the pseudo band expansion processing (S2) described in conjunction with FIG. 5 will be described. FIG. 6 is a flowchart illustrating an example of operations of a voice processing function.

In FIG. 6, the copy component extraction unit 102 extracts a copy component (S11).

Extraction of data performed by the copy-component extraction unit 102 is performed, for example, by setting the extraction range frequencies. For example, when the extraction range of a copy component is set to 1.5 kHz to 3.5 kHz, the target for extraction is an input voice in a frequency range of 1.5 kHz to 3.5 kHz, as illustrated in FIG. 7A. Note that the extraction range may be set, for example, by using a frequency value serving as a reference, and by specifying a bandwidth. In the example of FIG. 7A, assuming that the frequency serving as a reference is 1.5 kHz, the extraction range may be set to a bandwidth of 2 kHz. The copy-component extraction unit 102 outputs an extracted copy component to the level-adjustment unit 104.

Next, the copy-component shaping unit 103 shapes the copy component input from the copy-component extraction unit 102 (S12).

FIG. 7A and FIG. 7B illustrate a case where the copy-component shaping unit 103 shapes data of a copy component by cutting frequencies of 1.5 kHz and below and those of 3.5 kHz and above from the input voice signal.

Figure 8:
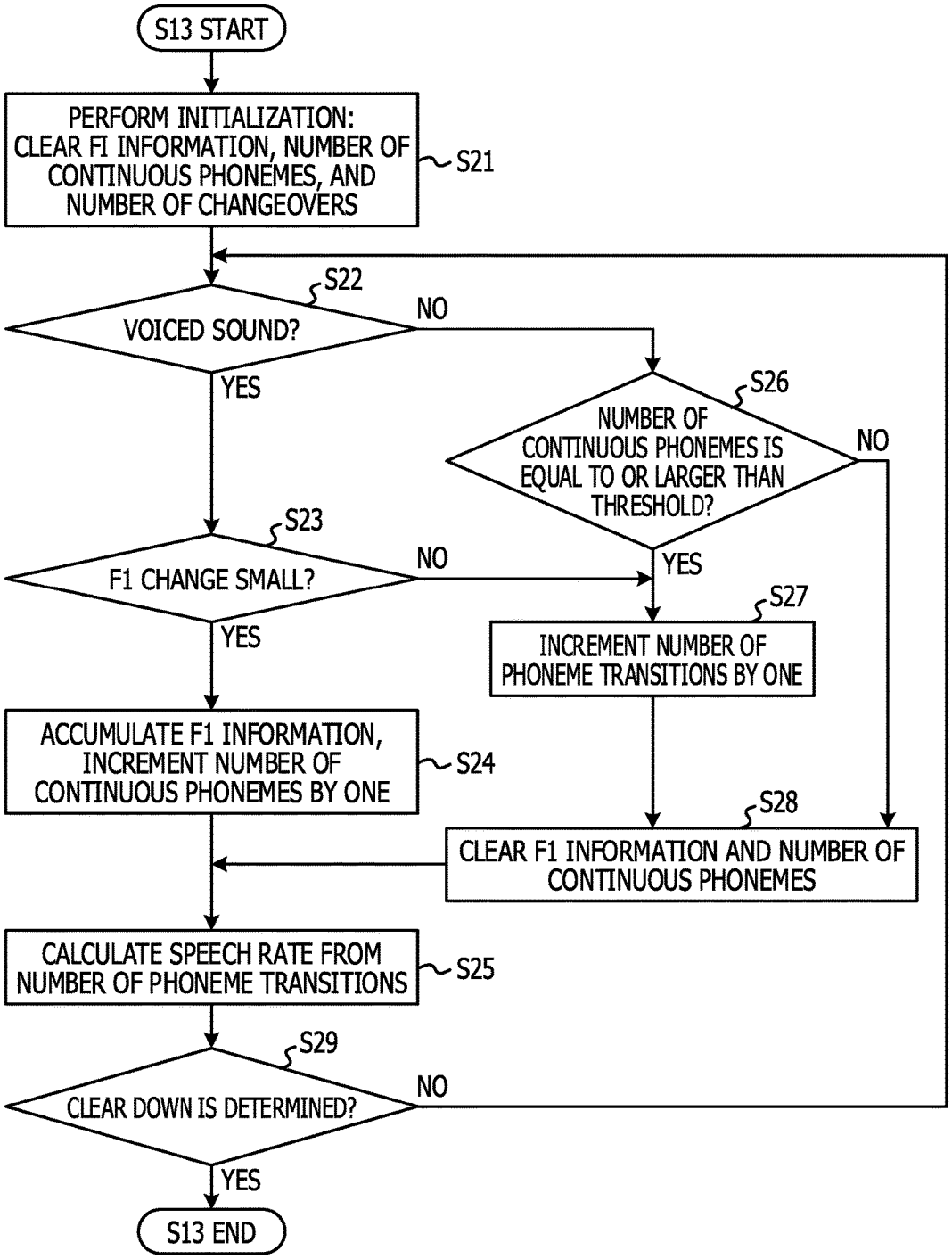
FIG. 8 is a flowchart illustrating an example of operations of the speech-rate detection unit.

The speech-rate detection unit 101 detects a speech rate and determines whether the detected speech rate is a high-speed speech rate (S13). Details of the speech-rate determination of step S13 are described with reference to FIG. 8. FIG. 8 is a flowchart illustrating an example of operations of the speech-rate detection unit 101.

In FIG. 8, the speech-rate detection unit 101 performs initialization (S21). The initialization is performed by clearing the counter 10131 that counts the F1 information of the formants, the counter 10132 that counts the number of continuous phonemes, and the counter 10133 that counts the number of phoneme transitions, in the variation detection unit 1013 described in conjunction with FIG. 4.

From a pitch strength detected by the pitch detection unit 1012, the variation detection unit 1013 determines whether an input voice is a voiced sound (S22).

If the variation detection unit 1013 determines that the input voice is a voiced sound (YES at S22), it is determined whether the change in F1 is smaller than a predetermined threshold value (S23).

If the change in F1 is equal to or less than the predetermined value (YES at S23), the counter 10131 and the counter 10132 are each incremented by one (S24). Here, the fact that the change in F1 is small in the voiced sound signifies that the phoneme of the input voice has not changed. The counter 10131 and the counter 10132 each count a predetermined number of frames, and do not count phoneme transitions until counting of the predetermined number of frames is completed. The counter 10131 and the counter 10132 are incremented until the phoneme has changed.

If the change in F1 is larger than the predetermined value (NO at S23), the counter 10133 that counts the number of phoneme transitions is incremented by one (S27). If the change in F1 is larger than the predetermined value, it is determined that the phoneme has been changed, and the number of transitions is counted. The number of phoneme transitions of the counter 10133 represents the number of morae of a voice. Determining the number of morae enables the speech rate, which is the reciprocal of the number of morae, to be calculated.

Next, the counter 10131 and the counter 10132 are cleared (S28). Clearing the counter 10131 and the counter 10132 allows a determination of the next phoneme transition to be made.

Next, the speech-rate calculation unit 1014 calculates and determines a speech rate from the number of phoneme transitions of the counter 10133. The speech rate may be determined by the number of phoneme transitions per unit time. A "high-speed speech rate" is determined when the speech rate is equal to or greater than a predetermined threshold value, and a "normal speech rate" is determined when the speech rate is less than a predetermined threshold value.

In contrast, if the variation detection unit 1013 determines that the input voice is a voiceless sound (NO at S22), it is determined whether the number of continuous phonemes is equal to or larger than the predetermined threshold value (S26). If the number of continuous phonemes is equal to or larger than the predetermined threshold (YES at S26), the counter 10133, which counts the number of phoneme transitions, is incremented by one (S27). If the change in F1 is small and the duration of a phoneme is long, a phoneme transition is determined based on a determination of a voiceless sound.

If the number of continuous phonemes is smaller than the predetermined threshold (NO at S26), the counter 10131 and the counter 10132 are cleared (S28), and the speech rate is calculated based on the number of phoneme transitions (S25).

Next, it is determined whether there is a clear down (S29). A clear-down determination is made during processing, similar to that at step S4. If no clear down is determined (NO at S29), the process returns to step S22, and the processing is repeated. If a clear down is determined (YES at S29), the speech-rate determination processing at step S13 is completed.

Note that the speech-rate detection unit 101 may determine a high-speed speech rate, for example, by the size of a pitch frequency distribution. Fast speaking results in a wide pitch frequency distribution. A threshold value is provided for the size of a frequency distribution determined, for example, by dispersion and standard deviation, so that the case where the size is equal to or larger than the threshold value may be determined as a high-speed speech rate.

With reference to FIG. 6, it is determined that the speech rate is a normal speech rate (NO at S13), and that the speech-rate detection unit 101 outputs to the level-adjustment unit 104 a correction value that causes normal attenuation of a copy component (S14). Thus, improved sound quality may be achieved by pseudo band expansion of an input at a normal speech rate.

In contrast, it is determined that if the speech rate is a high-speed speech rate (YES at S13), the speech-rate detection unit 101 outputs, to the level-adjustment unit 104, a correction value that causes the attenuation of a copy component to be larger than normal attenuation (S15). This may reduce the noisy feeling of a high-pitched sound that occurs when the speech rate is high, thereby improving the sound quality.

Figure 9:
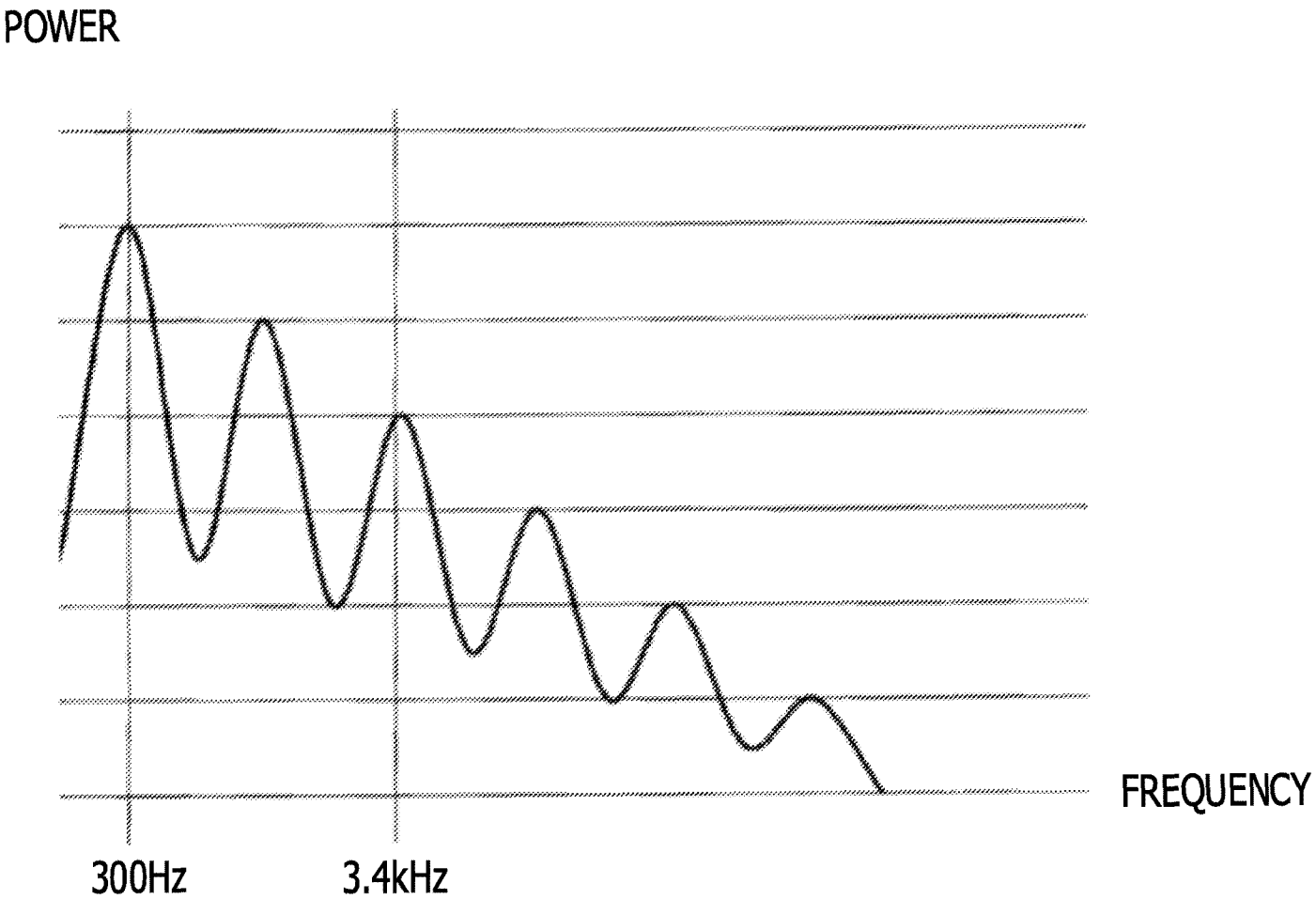
FIG. 9 is a graph illustrating frequency characteristics of an input voice.
Figure 10:
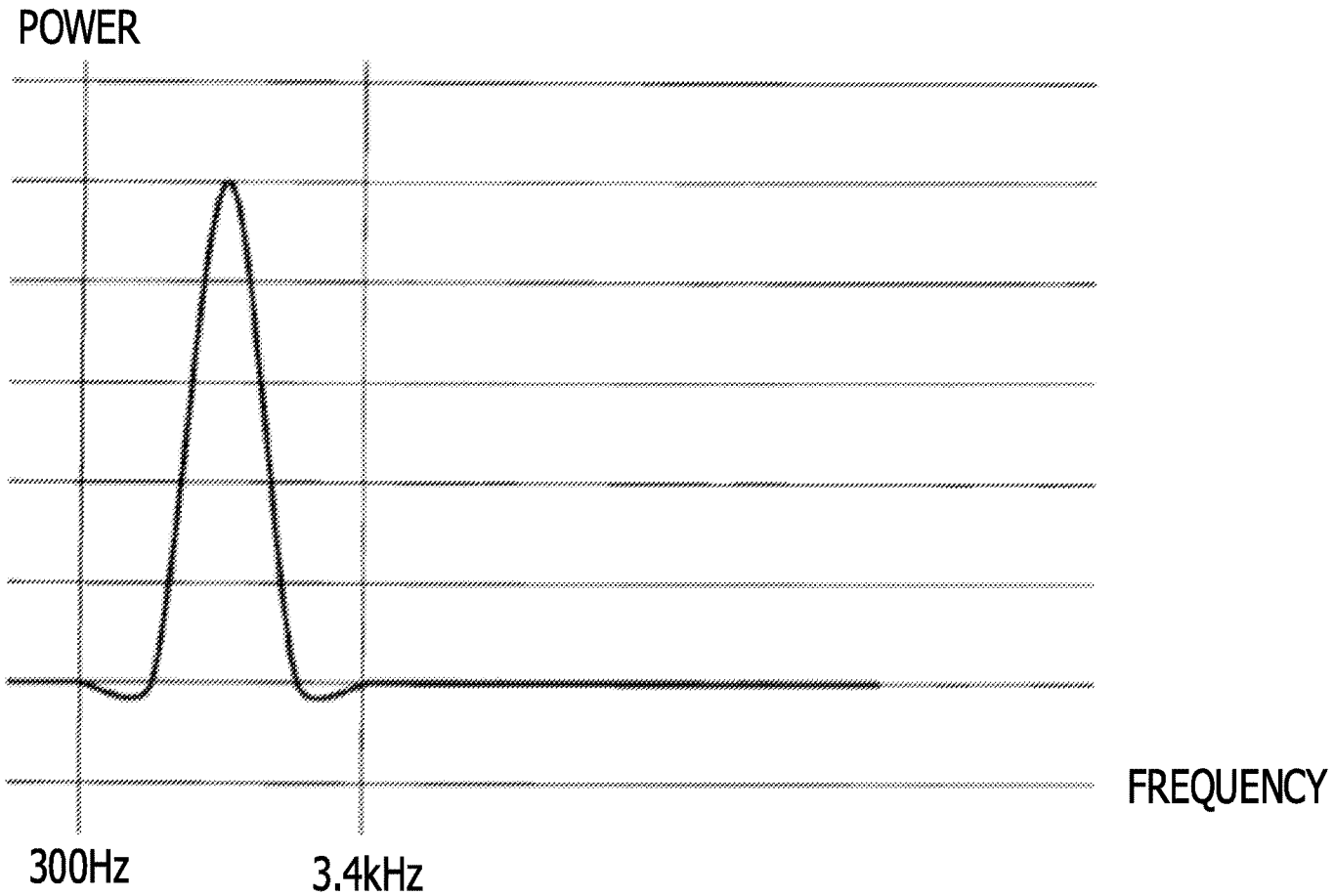
FIG. 10 is a graph illustrating frequency characteristics of a consonant of the input voice.

Here, with reference to FIG. 9 and FIG. 10, an effect of reducing the noisy feeling of a high-pitched sound that occurs when the speech rate is high will be described. FIG. 9 is an example of a graph illustrating the frequency characteristics of an input voice. FIG. 10 is an example of a graph illustrating the frequency characteristics of a consonant of an input voice.

In FIG. 9, an input voice generally has a harmonic structure. The harmonic structure refers to a structure in which a number of peaks exist at predetermined frequency intervals. It is known that, in a voice, particularly a vowel portion thereof has a harmonic structure.

In voice communication, in order to decrease the amount of data transmitted and received, an input voice, for example, is sampled in the range of 300 Hz to 3.4 kHz, and sounds outside this frequency band are removed. Consequently, the output voice does not have a frequency component extending beyond the frequency band in which the input voice is sampled, and thus does not offer a sense of presence.

In contrast, in FIG. 10, the consonant of an input voice has frequency characteristics in which the input voice has a peak at a predetermined frequency and does not have the same harmonic structure as a vowel.

The pseudo band expansion is a technology in which, as described in conjunction with FIG. 7, a receiving-side device generates, from a received voice in the range of 300 Hz to 3.4 kHz, another frequency band in a pseudo manner, and thus regenerates the original voice.

Accordingly, if a voice signal of a vowel without a harmonic structure is copied so that a voice signal in another frequency band is generated in a pseudo manner, a sound in a frequency band that does not originally exist is generated. This is a cause of producing a noisy feeling.

Since there are few consonants per unit time when the speech rate is slow, there are also few noisy feelings due to pseudo band expansion. In contrast, since there are many consonants per unit time when the speech rate is high, the noisy feeling of a high-pitched sound increases.

In this embodiment, attenuation of a copy component is increased beyond normal attenuation when the speech rate is high. This makes it possible to decrease the gain of a noise component to reduce a noisy feeling while performing band expansion.

Note that adjusting the degree of frequency shift of a copy component and adjusting extension or contraction of the frequency band for a copy component to be expanded, as described in conjunction with FIG. 7, may have effects similar to those obtained by increasing the attenuation, that is, the effect of reducing a noisy feeling while performing band expansion.

Additionally, although, in this embodiment, correction values of two levels, a high-speed speech rate and a normal speech rate, are output according to speech-rate determinations, correction values may be, for example, adjusted to be in three or more levels or to be in a stepless manner in accordance with the attenuation-level speech rate. Additionally, a non-linear correction curve may be applied to a correction value and be output to the level-adjustment unit 104.

With reference to FIG. 6, the copy-component addition unit 105 adds a copy component adjusted in the level-adjustment unit to an input voice, and outputs an output voice (S16).

Next, it is determined whether there is a clear down (S17). The clear-down determination is performed by processing similar to that at step S4. If no clear down is determined (NO at S29), the process returns to step S22, and the processing is repeated. If a clear down is determined (YES at S29), the processing of a speech-rate determination at step S13 is completed. The clear-down determination is performed by processing similar to that at step S4. If no clear down is determined (NO at S17), the process returns to step S11, and the processing is repeated. If a clear down is determined (YES at S17), the pseudo band expansion processing at step S2 is completed.

Next, with reference to FIG. 11, an example of detection of formants and pitch strengths performed by the formant detection unit and the pitch detection unit 1012 of the speech-rate detection unit 101 described in conjunction with FIG. 4 will be described. FIGS. 11A to 11C are a graph illustrating temporal changes of the original sound (FIG. 11A), a graph illustrating formants of the original sound (FIG. 11B), and a graph illustrating the pitch strengths of the original sound (FIG. 11C) for explaining an example of processing of the formant detection unit.

Figure 11A:
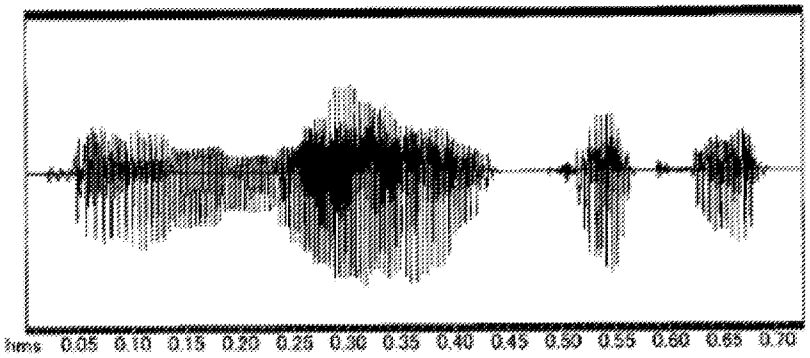
FIG. 11A is a graph illustrating temporal changes of the original sound for explaining processing of the formant detection unit.
Figure 11B:
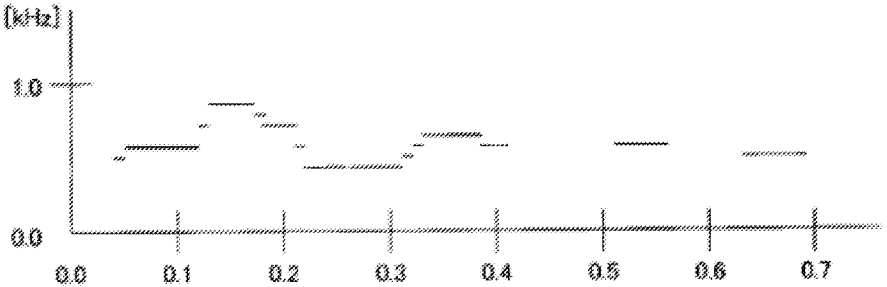
FIG. 11B is a graph illustrating formants of the original sound.
Figure 11C:
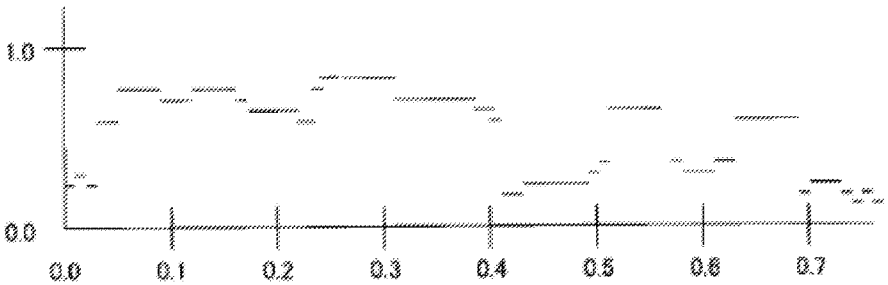
FIG. 11C is a graph illustrating pitch strengths of the original sound.

In FIG. 11A, the original sound of an input voice has waveforms temporally illustrated. Note that the horizontal axes of FIG. 11A to FIG. 11C each represent elapsed time.

Upon input of an input voice of FIG. 11A, the formant detection unit 1011 calculates F1 on a frame-by-frame basis (10 ms in this embodiment). FIG. 11B illustrates a calculation result of F1 for the original sound. The vertical axis of FIG. 11B represents the frequency (kHz). A phoneme transition in a voiceless sound portion may be determined by the degree of a change in F1.

Upon input of an input voice of FIG. 11A, the pitch detection unit 1012 calculates the pitch strength from the maximum value of an autocorrelation coefficient. FIG. 11C illustrates a calculation result of pitch strengths for the original sound.

Second Embodiment

Figure 12:
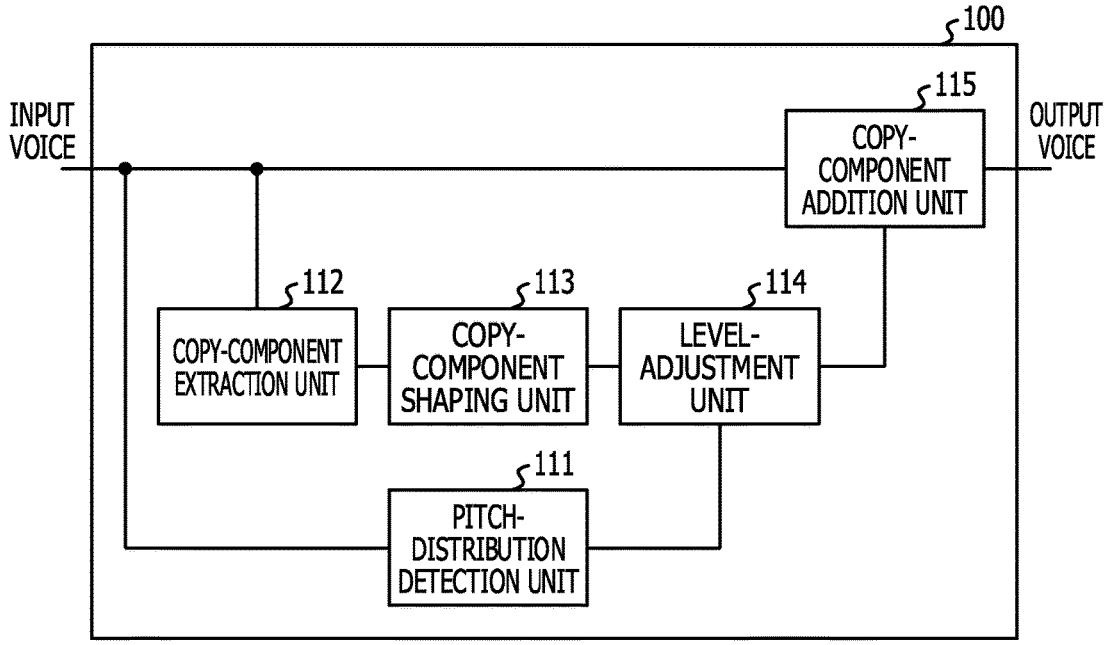
FIG. 12 is a diagram illustrating an example of a configuration of a voice processing function in a second embodiment.

Next, with reference to FIG. 12, a second embodiment of the voice processing function 100 will be described. FIG. 12 is a diagram illustrating an example of a configuration of the voice processing function 100 in the second embodiment.

In FIG. 12, the voice processing function 100 includes a pitch-distribution detection unit 111, a copy-component extraction unit 112, a copy-component shaping unit 113, a level-adjustment unit 114, and a copy-component addition unit 115.

The difference between the second embodiment and the first embodiment is that the pitch-distribution detection unit 111 is included instead of the speech-rate detection unit 101 in the first embodiment. The copy-component extraction unit 112, the copy-component shaping unit 113, the level-adjustment unit 114, and the copy-component addition unit 115 have the same configurations as in the first embodiment, and description thereof is omitted.

The pitch-distribution detection unit 111 adds up distributions of pitch frequencies of an input voice.

The pitch frequency may be measured using the frequencies of a voiced sound. For example, when the strain state of a voice is high, the intonation of the voice decreases, and the width of a pitch frequency distribution decreases. In contrast, in the case of a voice in an excited state, the pitch frequency distribution is wide. In this embodiment, a strain state and an excited state may be measured by the size of a pitch frequency distribution.

The pitch-distribution detection unit 111 detects whether a pitch frequency distribution falls within the range of a predetermined value. If the pitch frequency distribution falls within the predetermined range, it is assumed that the distribution is a normal pitch distribution, and a correction value output to the level-adjustment unit 114 is set as a normal attenuation factor. Thus, improved sound quality may be achieved by pseudo band expansion of an input voice at a normal speech rate.

In contrast, if the pitch frequency distribution does not fall within the predetermined value range, the pitch-distribution detection unit 111 assumes that the pitch distribution is wider or narrower and sets the attenuation factor to be higher or lower, and outputs a correction value to the level-adjustment unit 114. Thus, decrease in sound quality may be inhibited when, for example, the degree of strain or the degree of excitement is high.

Note that although, in the second embodiment, the pitch-distribution detection unit 111 outputs correction values of two levels for a pitch distribution, multiple-level correction values may be output instead of two-level correction values. Additionally, stepless correction values may be output.

While the embodiments of the present disclosure have been described in detail above, the present disclosure is not limited to such specific embodiments, and various modifications and changes may be made without departing from the gist of the present disclosure as claimed.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A communication device comprising:

a memory; and a processor coupled to the memory, the processor configured to:

extract a frequency component of a voice signal that is input to the processor, detect a speech rate of the voice signal, the speech rate being a speed at which a speaker speaks the voice signal, adjust the extracted frequency component by applying a first attenuation factor to the extracted frequency component in response to the speech rate being at or above a threshold or by applying a second attenuation factor in response to the speech rate being below the threshold, the first attenuation factor being larger than the second attenuation factor, add the adjusted frequency component to the voice signal to generate an adjusted voice signal with a frequency bandwidth larger than a frequency bandwidth of the voice signal, and output the adjusted voice signal.

2. The communication device according to claim 1, wherein the processor is configured to determine the speech rate in accordance with a pitch distribution of the voice signal.

3. The communication device according to claim 1, wherein the processor is configured to adjust a frequency bandwidth of the frequency component when adjusting the frequency component.

4. The communication device according to claim 1, wherein the processor is configured to adjust a degree of frequency shift of the frequency component when adjusting the frequency component.

5. The communication device according to claim 1, wherein the frequency component includes a plurality of sequential frequencies and only includes a part of all of the frequencies of the voice signal input to the processor.

6. The communication device according to claim 1, further comprising a digital-to-analog converter coupled to the processor, the digital-to-analog converter configured to receive the adjusted voice signal from the processor and to generate a speaker output based on the adjusted voice signal.

7. The communication device according to claim 1,
further comprising a speaker, wherein the adjusted voice signal output by the processor is output through the speaker.

8. The communication device according to claim 1,
wherein processor is further configured to frequency shift the frequency component outside the frequency bandwidth of the voice signal before the frequency component is added to the voice signal.

9. A method, comprising:
extracting a frequency component of a voice signal that is input to a computing system;
detecting a speech rate of the voice signal, the speech rate being a speed at which a speaker speaks the voice signal;
adjusting the extracted frequency component by applying a first attenuation factor to the extracted frequency component in response to the speech rate being at or above a threshold or by applying a second attenuation factor in response to the speech rate being below the threshold, the first attenuation factor being larger than the second attenuation factor;
adding the adjusted frequency component to the voice signal to generate an adjusted voice signal with a frequency bandwidth larger than a frequency bandwidth of the voice signal; and
outputting the adjusted voice signal from the computing system.

10. The method to claim 9,
wherein the speech rate is determined in accordance with a pitch distribution of the voice signal.

11. The method to claim 9,
further comprising adjusting a frequency bandwidth of the frequency component.

12. The method to claim 9,
further comprising adjusting a degree of frequency shift of the frequency component.

13. The method to claim 9,
wherein the frequency component includes a plurality of sequential frequencies and only includes a part of all of the frequencies of the voice signal input to the computing system.

14. The method to claim 9,
further comprising generating a speaker output based on the adjusted voice signal.

15. The method to claim 9,
further comprising outputting the adjusted voice signal through a speaker.

16. The method to claim 9,
further comprising frequency shifting the frequency component outside the frequency bandwidth of the voice signal before the frequency component is added to the voice signal.

17. One or more non-transitory computer-readable storage media configured to store instructions that when executed by one or more processors cause one or more computing systems to perform operations, the operations comprising:
extracting a frequency component of a voice signal;
detecting a speech rate of the voice signal, the speech rate being a speed at which a speaker speaks the voice signal;
adjusting the extracted frequency component by applying a first attenuation factor to the extracted frequency component in response to the speech rate being at or above a threshold or by applying a second attenuation factor in response to the speech rate being below the threshold, the first attenuation factor being larger than the second attenuation factor;
adding the adjusted frequency component to the voice signal to generate an adjusted voice signal with a frequency bandwidth larger than a frequency bandwidth of the voice signal; and
outputting the adjusted voice signal.

* * * * *